US010112070B2

(12) United States Patent
Kao

(10) Patent No.: US 10,112,070 B2
(45) Date of Patent: Oct. 30, 2018

(54) BALANCE TRAINING DEVICE FOR YOUNG CHILDREN

(71) Applicant: I SHYANG ENTERPRISE CO., LTD., Tainan (TW)

(72) Inventor: Yao-Tsung Kao, Tainan (TW)

(73) Assignee: I Shyang Enterprise Co., Ltd., Tainan (TW)

( * ) Notice: Subject to any disclaimer, the term of this patent is extended or adjusted under 35 U.S.C. 154(b) by 0 days.

(21) Appl. No.: 15/599,661

(22) Filed: May 19, 2017

(65) Prior Publication Data

US 2018/0117389 A1 May 3, 2018

(30) Foreign Application Priority Data

Nov. 2, 2016 (TW) ..... 105216690 U

(51) Int. Cl.
*A63B 21/00* (2006.01)
*A63B 23/04* (2006.01)
*A63B 22/14* (2006.01)

(52) U.S. Cl.
CPC ..... *A63B 21/4034* (2015.10); *A63B 23/04* (2013.01); *A63B 22/14* (2013.01); *A63B 23/0458* (2013.01); *A63B 2208/12* (2013.01)

(58) Field of Classification Search
CPC . A63B 21/4034; A63B 22/14; A63B 23/0458; A63B 2208/12
See application file for complete search history.

(56) References Cited

U.S. PATENT DOCUMENTS 1,747,721 A * 2/1930 Lowman ..... A63B 4/00 482/34
3,580,568 A * 5/1971 Stone ..... A63B 4/00 482/34
4,105,201 A * 8/1978 L'Ecuyer ..... A63B 4/00 482/34
4,579,346 A * 4/1986 Giuntoli ..... A63F 3/00574 273/258
5,269,735 A * 12/1993 Pfitzenmeier ..... A63B 22/16 472/108
5,328,421 A * 7/1994 Stanalajczo ..... A63B 22/16 482/34
5,765,921 A * 6/1998 Chuang ..... A47C 16/025 297/423.41
6,117,051 A * 9/2000 Suarez ..... A63B 21/078 482/51
6,619,601 B1 * 9/2003 Vall ..... A47B 13/02 108/158.12
6,705,977 B1 * 3/2004 Ziak ..... A63B 21/0004 472/135
7,771,327 B1 * 8/2010 Reams ..... A63B 21/0552 482/123

(Continued)

*Primary Examiner* — Joshua Lee
(74) *Attorney, Agent, or Firm* — Rosenberg, Klein & Lee

(57) ABSTRACT

A balance training device for young children is revealed. The balance training device includes a footplate, at least one support disposed on a bottom surface of the footplate and at least one base connected to the support. The footplate, the support and the base are combined in different ways to form various playing modes including a see-saw mode, a ramp mode, a balance beam mode, etc. Thus the balance training device not only attracts young children to play but also improves their balance and trains their leg muscles in the play.

4 Claims, 6 Drawing Sheets

(56) References Cited

U.S. PATENT DOCUMENTS

| | | | | |
|---|---|---|---|---|
| 2002/0147087 | A1* | 10/2002 | Tollner | A63B 22/16 482/147 |
| 2006/0270536 | A1* | 11/2006 | Tukada | A63B 22/16 482/146 |
| 2011/0098164 | A1* | 4/2011 | Chang | A63B 4/00 482/146 |
| 2011/0263398 | A1* | 10/2011 | Klassen | A63B 22/16 482/146 |
| 2014/0221182 | A1* | 8/2014 | Lin | A63B 21/0004 482/142 |
| 2017/0043219 | A1* | 2/2017 | Polinsky | A63B 26/003 |

* cited by examiner

BALANCE TRAINING DEVICE FOR YOUNG CHILDREN

BACKGROUND OF THE INVENTION

Field of the Invention

The present invention relates to a balance training device, especially to a balance training device for young children which provides various playing modes for attracting young children to play and training their balance and leg muscles in the play.

Description of Related Art

Parents and teachers use different toys and devices for training sensory integration and various muscles of young children in the play in the growing stage of the young children. Among various trainings, balance in walking is the most important of all for people since walking is essential for our daily life activities. The young children gradually develop cognitive functions of space/depth, their positions and an object's position after starting walking.

However, the young children are lack of self-control and concentration. Thus curiosity plays an important role in children's learning and training. The toys/devices with single function and lower interest easily lead to loss of freshness for young children. The young children play the toys/devices only for a while and soon abandon the toys/devices. This also causes waste of resources and storage difficulty. Thus there is room for improvement and there is a need to provide a device with various playing mode for attracting the young children's curious attention in the play and training both balance in walking and muscular coordination happily. The problems of the training devices available now such as short life cycle and waste of resources can also be solved.

SUMMARY OF THE INVENTION

Therefore it is a primary object of the present invention to provide a balance training device for young children which offers various playing modes for attracting young children to play and training their balance and muscles in the play.

In order to achieve the above object, a balance training device for young children according to the present invention includes a footplate mounted with at least one assembly hole formed on a bottom surface thereof, at least one support disposed under the footplate and at least one base arranged under the support. An assembly pin is projecting from a top end of the support and is used to connect to the assembly hole of the footplate. A positioning slot is formed on a top end of the base. A bottom end of the support is mounted in the positioning slot of the base. The support is matched with the positioning slot of the base in a clearance fit.

A curved portion is formed on the bottom end of the support.

A ramp inclined downward is formed on one side of a top surface of the base, opposite to the side of the base with the positioning slot.

A recess portion is formed on the bottom surface of the footplate. A plurality of longitudinal ribs and a plurality of transverse ribs are disposed on the recess portion at intervals. The longitudinal ribs and the transverse ribs are arranged in a crisscross pattern. Moreover, the assembly hole is preferably located on intersection area of the longitudinal rib and the transverse rib. A fixing block is arranged at each of two sides of the assembly pin on the top end of the support. Each fixing block is set with a mounting groove for mounting and fixing the transverse ribs located on two sides of the assembly hole and the bottom surface of the footplate.

A center and each of two ends of the footplate are set with one assembly hole respectively.

Thereby various playing modes including a see-saw mode, a ramp mode, a balance beam mode, etc. of the present invention are offered by combinations of the footplate, at least one support and at least one base. The interest in the play is increased and the young children are attracted. Their balance and leg muscles are also trained in the play.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
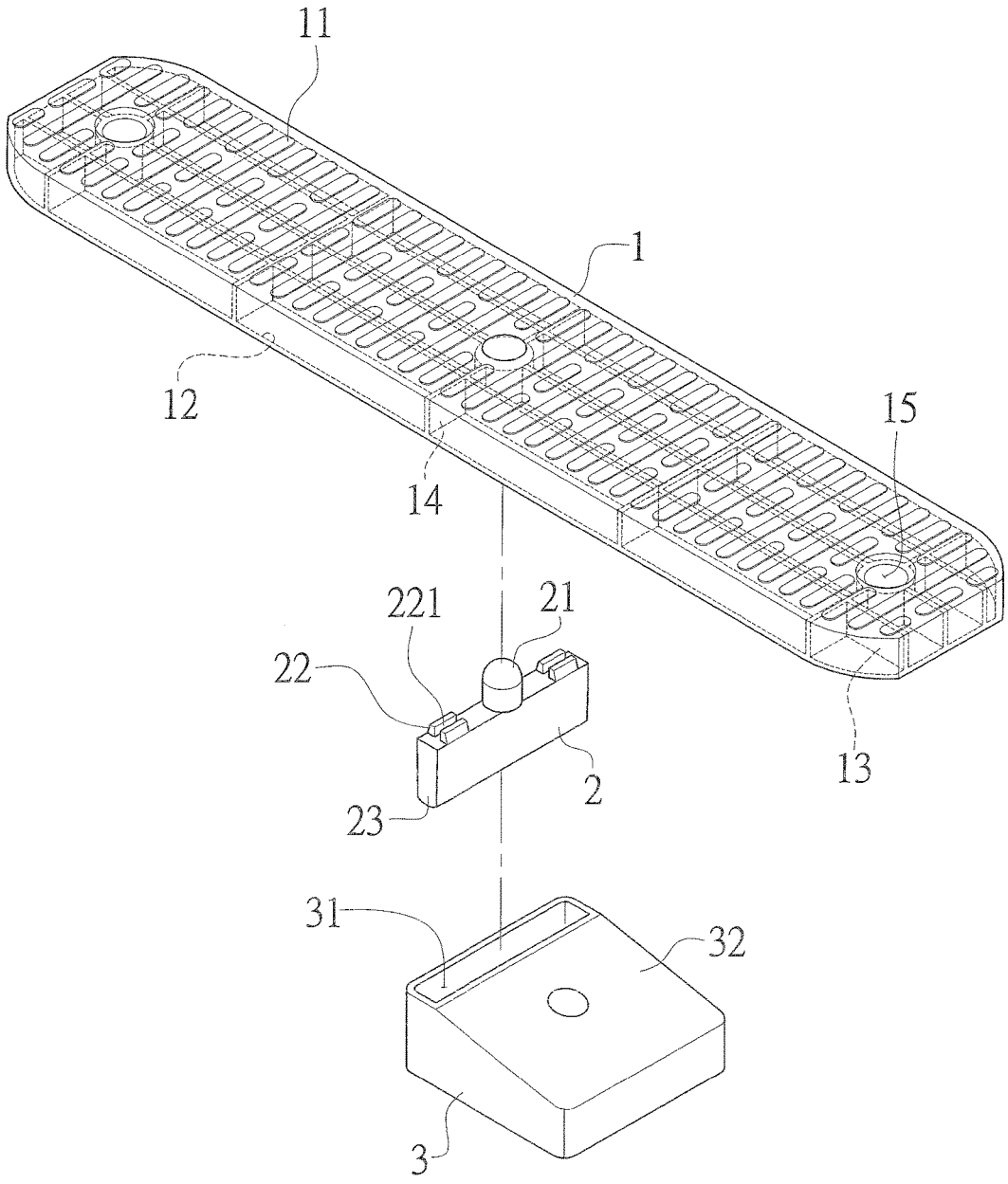
FIG. 1 is an explosive view of an embodiment according to the present invention.
Figure 2:
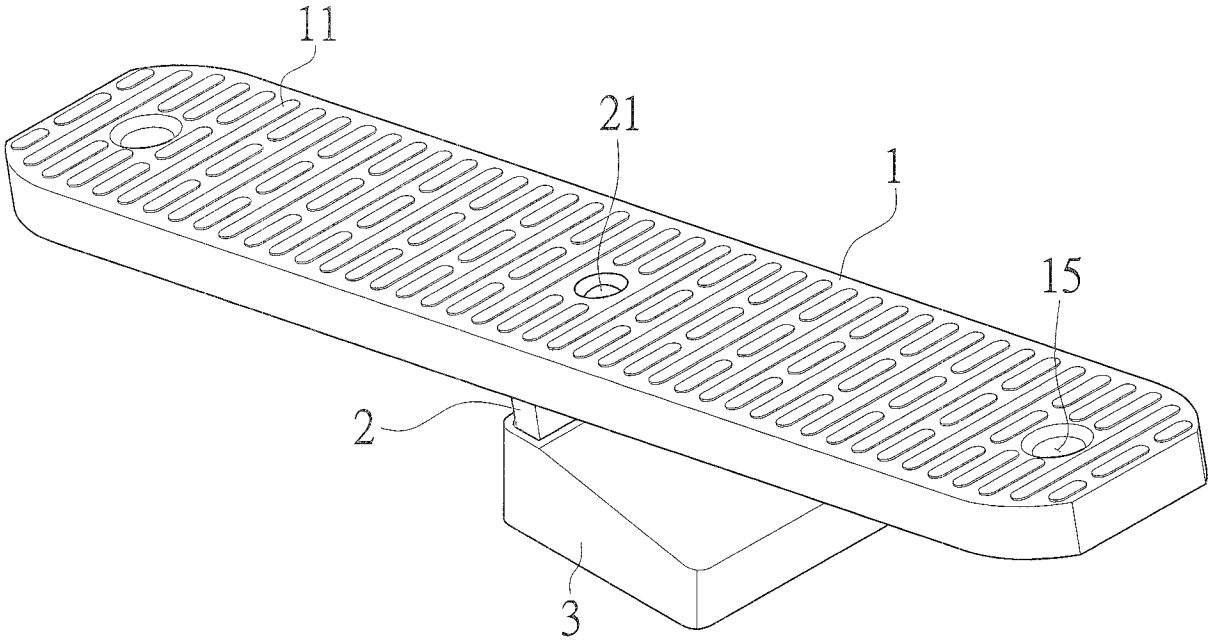
FIG. 2 is a perspective view of an embodiment according to the present invention.

Refer to FIG. 1 and FIG. 2, a balance training device for young children according to the present invention includes a footplate 1, at least one support 2 and at least one base 3.

An anti-slip portion 11 is formed on a top surface of the footplate 1 and a recess portion 12 is formed on a bottom surface of the footplate 1. The anti-slip portion 11 can be a plurality of anti-slip bumps. A plurality of longitudinal ribs 13 and a plurality of transverse ribs 14 are disposed on the recess portion 12 with an interval between two adjacent ribs 13, 14. The longitudinal ribs 13 and the transverse ribs 14 are arranged in a crisscross pattern. The footplate 1 further includes at least one assembly hole 15 that penetrates the footplate 1, extending from the top surface to the bottom surface of the footplate 1. The assembly hole 15 is preferably located on intersection area of the longitudinal rib 13 and the transverse rib 14. In this embodiment, a center, the left end and the right end of the footplate 1 are set with one assembly hole 15 respectively.

Figure 3:
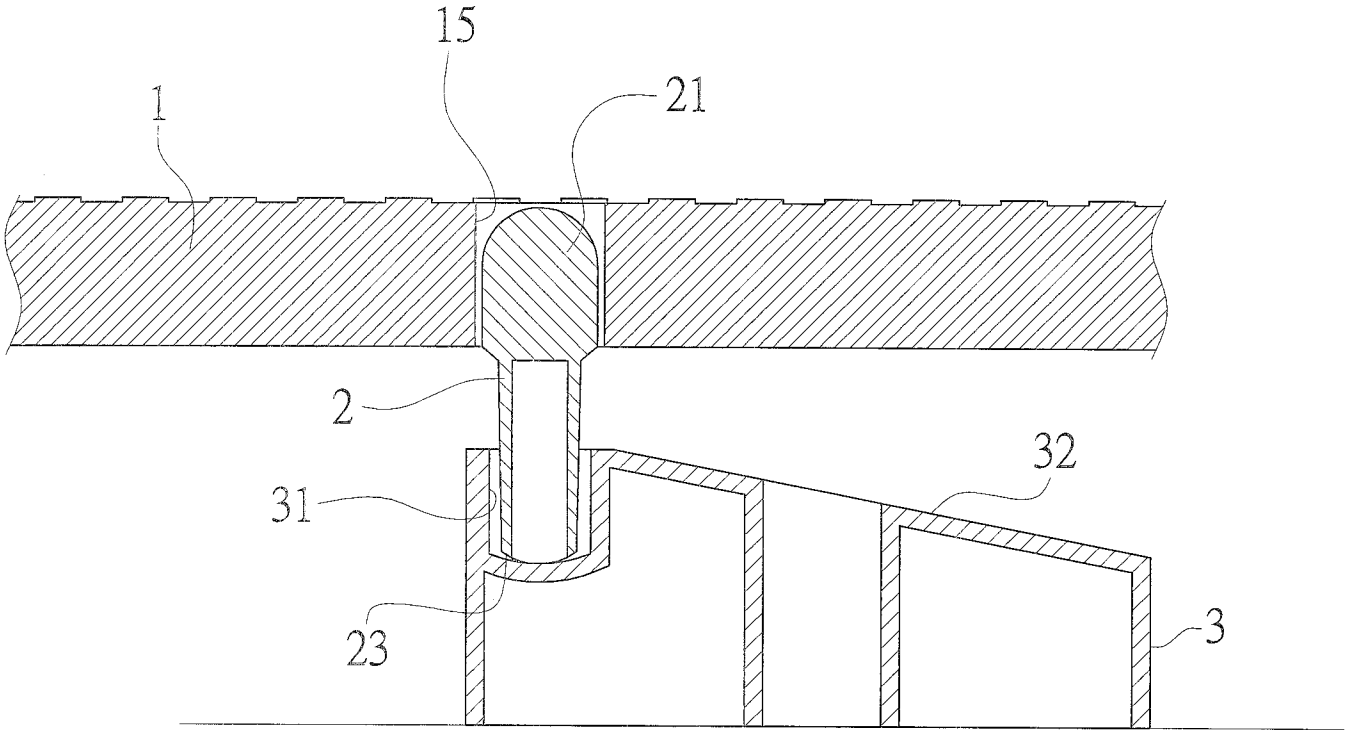
FIG. 3 is a partial enlarged view of an embodiment according to the present invention.
Figure 4:
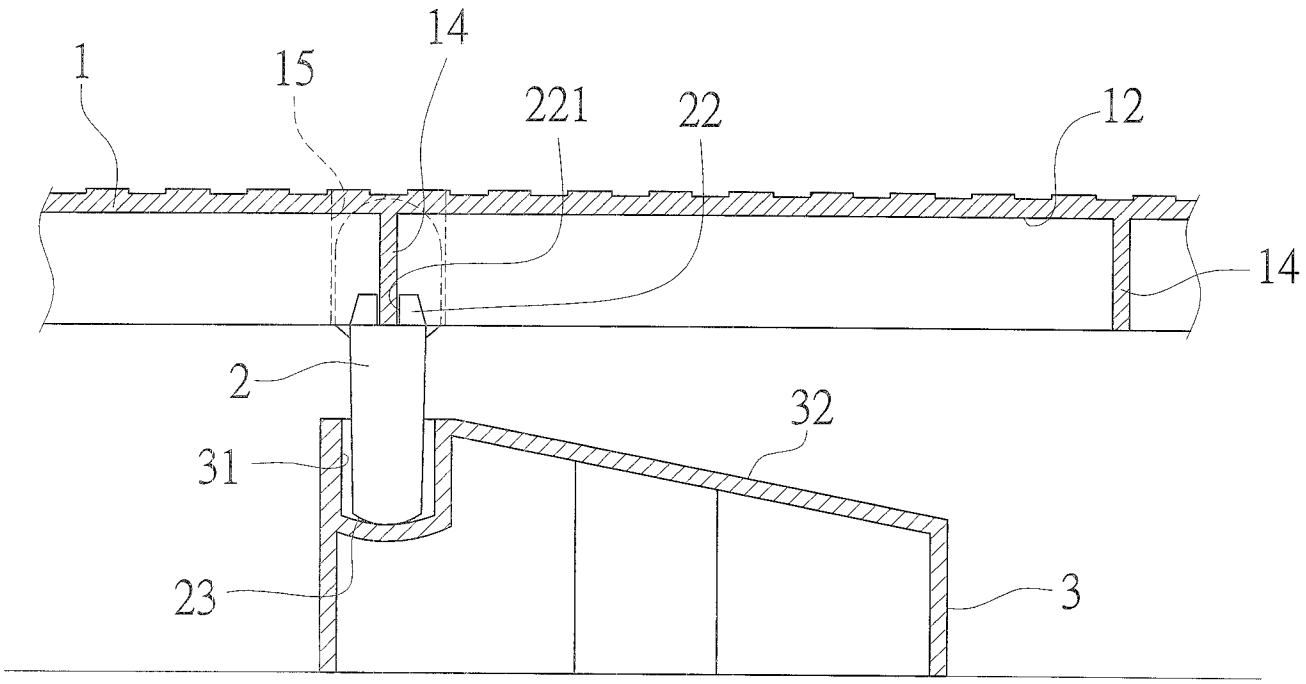
FIG. 4 is another partial enlarged view of an embodiment according to the present invention.

The support 2 is arranged under the footplate 1. An assembly pin 21 is projecting from a top end of the support 2 and is used to pass through and connect to the assembly hole 15 of the footplate 1, as shown in FIG. 3. A fixing block 22 is arranged at each of two sides of the assembly pin 21 on the top end of the support 2. Each fixing block 22 is set with a mounting groove 221 for mounting and fixing the transverse ribs 14 located on the bottom surface of the footplate 1 and two sides of the assembly hole 15, as shown in FIG. 4. A curved portion 23 is formed on a bottom end of the support 2.

The base 3 is set under the support 2. A positioning slot 31 is formed on a top end of the base 3 and the bottom end of the support 2 is mounted in the positioning slot 31 of the base 3. The support 2 is matched with the positioning slot 31 of the base 3 in a clearance fit. A ramp 32 inclined downward is formed on one side of a top surface of the base 3, opposite to the side of the base 3 with the positioning slot 31.

While being assembled, the assembly pin 21 of the support 2 is connected to the assembly hole 15 at the center of the footplate 1 and the transverse ribs 14 on two sides of the assembly hole 15 on the bottom surface of the footplate 1 are mounted into the mounting groove 221 of each fixing block 22 of the support 2 correspondingly. Thereby the present invention is in a see-saw mode. While in use, young children can step on the top surface of the footplate 1 and each foot is located on each of two sides of the center of the footplate 1. When the young child shifts the weight toward the left side of the footplate 1, the footplate 1 is inclined toward the left side owing to the clearance fit between the curved portion 23 on the bottom of the support 2 and the positioning slot 31 of the base 3. Similarly, the footplate 1 is inclined toward the right side when the young child shifts the weight to the tight side of the footplate 1. Thus the young children can control the inclined direction of the footplate 1 by shifting their body weight for training their balance and leg muscles.

Figure 5:
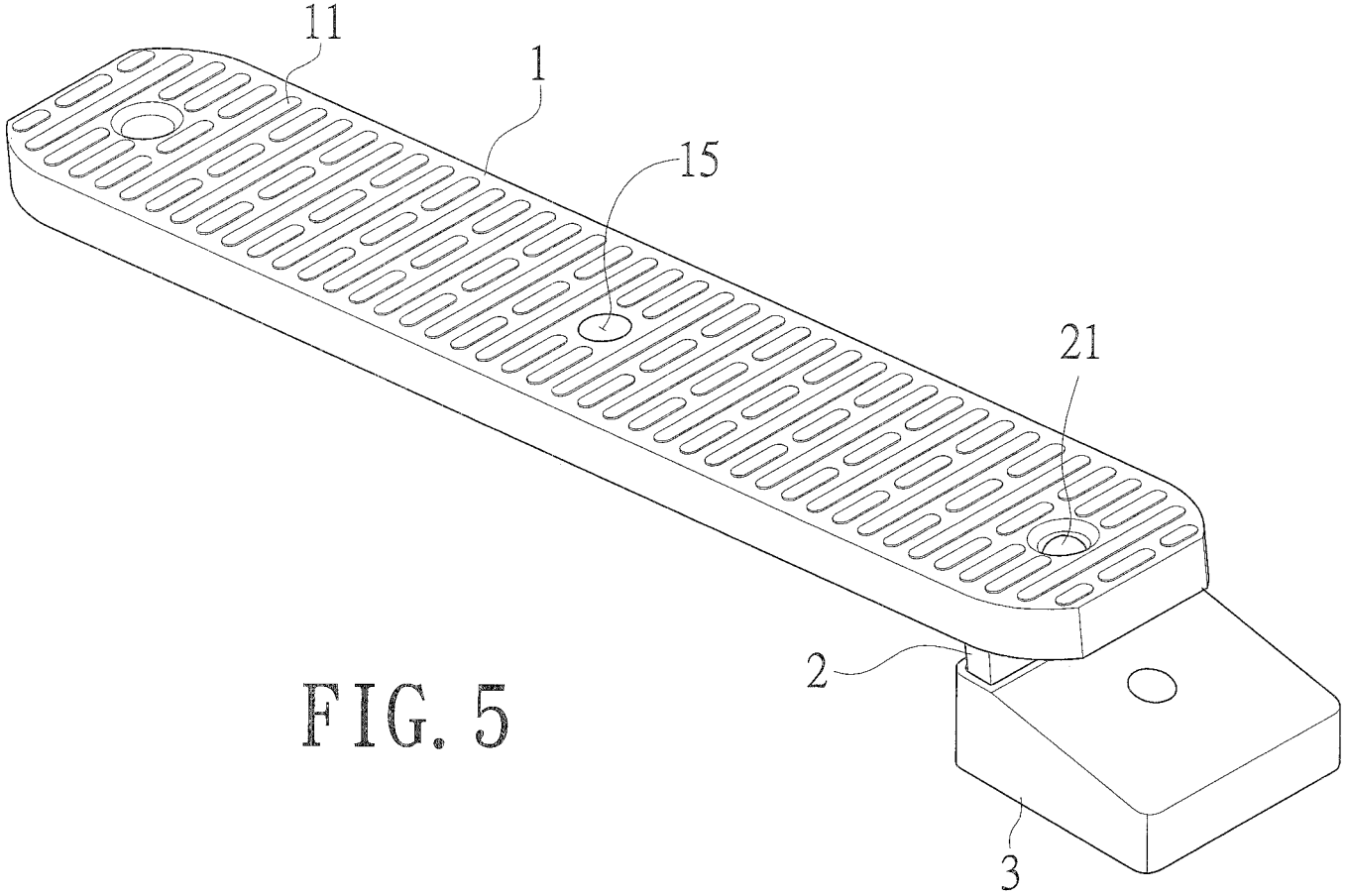
FIG. 5 is a perspective view of another embodiment according to the present invention.
Figure 6:
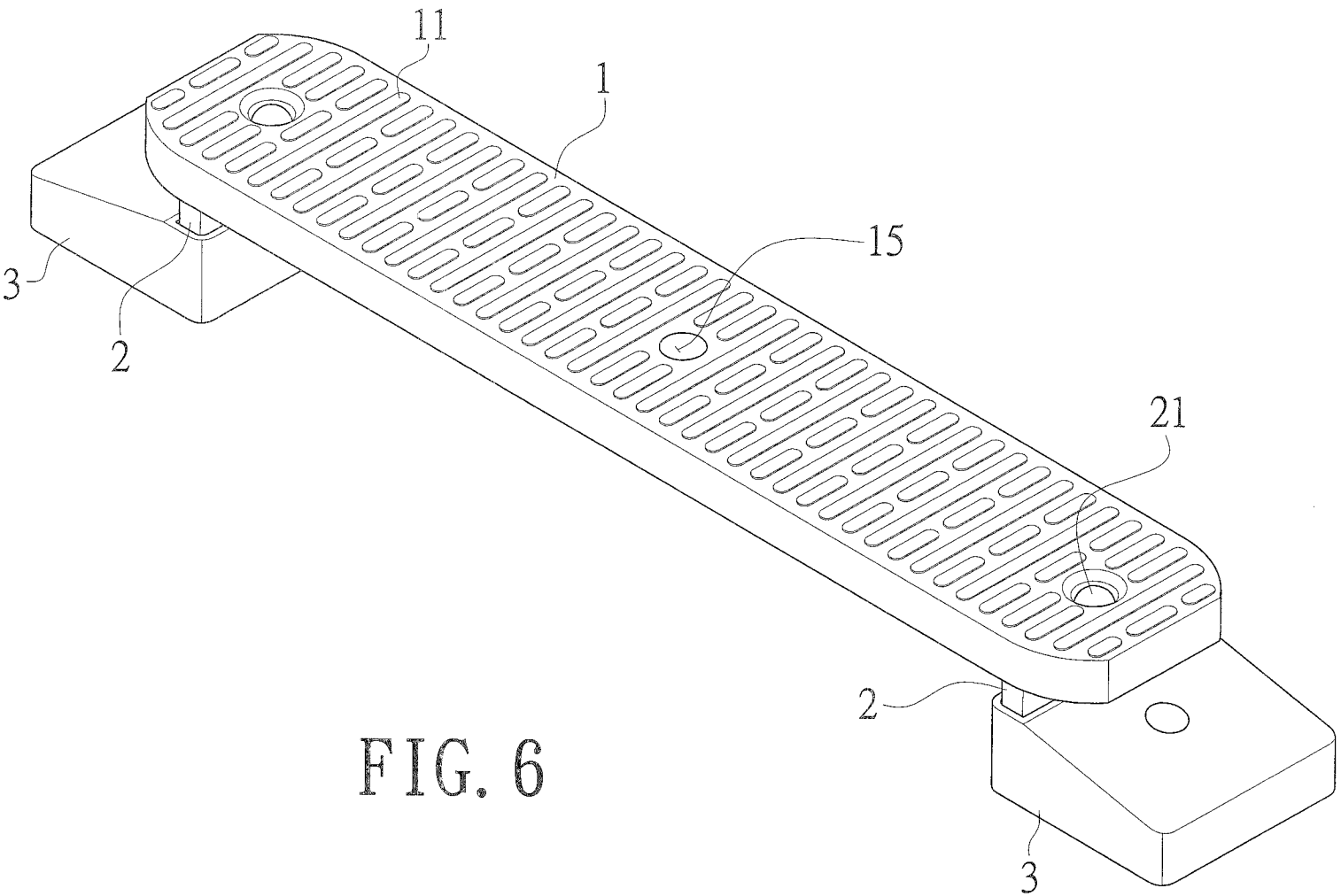
FIG. 6 is a perspective view of a further embodiment according to the present invention.

Moreover, refer to FIG. 5, the assembly pin 21 of the support can be connected to the assembly hole 15 on the left side or the right side of the footplate 1 when parents or teachers intend to train children's leg muscles further. Thus the footplate 1 is inclined from one side thereof with the support 2 to the other side thereof. Thereby the present invention in the ramp mode can be used for training leg muscles of the young children when they are walking up or down the ramp. Refer to FIG. 6, each assembly hole 15 on the left side and the right side of the footplate 1 is mounted with one assembly pin 21 of the support 2 to form a balance beam. The young children need to keep balance and avoid falling from the footplate 1 while stepping on the footplate 1 that is suspended on the supports 2 on two sides thereof. The footplate 1 can be further arranged with a transverse bar thereabove. The transverse bar is used as an obstacle so that the young children need to raise the leg for passing the transverse bar and moving on. Thereby the balance ability in single-leg stance of the young children is improved and the interest in the play is increased.

Thereby the balance training device of the present invention has various modes formed by different combinations of the footplate 1, at least one support 2 and at least one base 3. The modes include a see-saw mode, a ramp mode, a balance beam mode, etc. The present balance training device can further be used together with obstacles such as a transverse bar for increasing interest, difficulty and freshness in the play. The design of the present balance training device keeps children's curiosity for playing alive and attracts them to play. In the play, the young children's balance in walking and coordination of leg muscles are also trained.

The assembly hole 15 of the footplate 1 is not limited to be passed through the top surface of the footplate 1. The assembly hole 15 can be only formed on the bottom surface of the footplate 1 without penetrating through the footplate 1. The assembly pin 21 of the support 2 can also be mounted in the assembly hole 15.

In summary, the present invention has the following advantages:

1. The present balance training device for young children provides various playing modes easily by combinations of only a few components including the footplate, at least one support and at least one base. Thus the interest in play is improved and multiple functions are provided by the present design. Therefore the shortcomings of the young children's learning and training device available now including short life cycle, waste of resources and storage difficulty can be solved.

2. The balance training device for young children according to the present invention has multiple playing modes including the see-saw mode, the ramp mode, the balance beam mode, etc. The different modes not only attract the children to play, but also improve children's balance and train their leg muscles.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A balance training device for young children comprising:

a footplate mounted with at least one assembly hole formed on a bottom surface thereof, a recess portion is formed on a bottom surface of the footplate; a plurality of longitudinal ribs and a plurality of transverse ribs are disposed on the recess portion at intervals; the assembly hole is arranged at an intersection area of one longitudinal rib and one transverse rib;

at least one support disposed under the footplate and having an assembly pin projecting from a top end thereof;

a fixing block set on each of two sides of the assembly pin on the top end of the support, each fixing block being disposed with a mounting groove for mounting and fixing a transverse rib located on each of two sides of the assembly hole on the bottom surface of the footplate; and at least one base arranged under the support and disposed with a positioning slot on a top end thereof;

wherein the assembly pin is able to be connected to the assembly hole of the footplate; a bottom end of the support is mounted in the positioning slot of the base; and the support and the positioning slot of the base are connected in a clearance fit.

2. The device as claimed in claim 1, wherein a curved portion is formed on the bottom end of the support.

3. The device as claimed in claim 1, wherein a ramp inclined downward is formed on one side of a top surface of the base, opposite to the side of the base with the positioning slot.

4. The device as claimed in claim 1, wherein a center and two ends of the footplate each has an assembly hole mounted therein.

* * * * *